US011493263B2

(12) United States Patent
Santoro

(10) Patent No.: US 11,493,263 B2
(45) Date of Patent: Nov. 8, 2022

(54) ICE CHEST LINER

(71) Applicant: Nicholas Santoro, Franklin Square, NY (US)

(72) Inventor: Nicholas Santoro, Franklin Square, NY (US)

( * ) Notice: Subject to any disclaimer, the term of this patent is extended or adjusted under 35 U.S.C. 154(b) by 0 days.

(21) Appl. No.: 17/496,978

(22) Filed: Oct. 8, 2021

(65) Prior Publication Data

US 2022/0113083 A1 Apr. 14, 2022

Related U.S. Application Data

(60) Provisional application No. 63/253,373, filed on Oct. 7, 2021, provisional application No. 63/089,750, filed on Oct. 9, 2020.

(51) Int. Cl.

| | |
|---|---|
| ***F25D 3/06*** | (2006.01) |
| ***B65D 25/20*** | (2006.01) |
| ***F25D 23/06*** | (2006.01) |
| ***B65D 21/08*** | (2006.01) |
| ***B65D 25/28*** | (2006.01) |
| ***B65D 81/26*** | (2006.01) |

(52) U.S. Cl.

CPC ..... *F25D 23/066* (2013.01); *B65D 21/086* (2013.01); *B65D 25/20* (2013.01); *B65D 25/2888* (2013.01); *B65D 81/261* (2013.01); *F25D 3/06* (2013.01)

(58) Field of Classification Search

CPC . B65D 25/02; F25D 3/06; F25D 3/066; F25D 3/08

See application file for complete search history.

(56) References Cited

U.S. PATENT DOCUMENTS

| | | | | |
|---|---|---|---|---|
| 5,372,269 | A * | 12/1994 | Sutton | B65F 1/06 220/666 |
| 5,590,804 | A * | 1/1997 | Crum | A47J 47/20 220/23.86 |
| 10,722,827 | B1 * | 7/2020 | Hetzner | E04H 4/1209 |
| 2010/0147015 | A1 * | 6/2010 | Vanderberg | F25D 3/06 62/457.7 |
| 2013/0334238 | A1 * | 12/2013 | Goforth | A47J 41/0088 220/772 |
| 2019/0174838 | A1 * | 6/2019 | D'Amato-Friedman | A41B 13/103 |

* cited by examiner

*Primary Examiner* — Andrew T Kirsch

(74) *Attorney, Agent, or Firm* — Carter, DeLuca & Farrell LLP; George Likourezos

(57) ABSTRACT

A basket for lining an ice chest includes four flexible walls configured to roll up, a bottom, and at least two handles. At least one wall includes perforations configured to allow water or ice to pass through the perforations. The four flexible walls are made of silicone, rubber, elastic, or any combination thereof.

20 Claims, 8 Drawing Sheets

ICE CHEST LINER

CROSS-REFERENCE TO RELATED APPLICATIONS

The present application claims the benefit of and priority to U.S. Provisional Application Ser. No. 63/089,750, filed on Oct. 9, 2020, and claims the benefit of and priority to U.S. Provisional Application Ser. No. 63/253,373, filed Oct. 7, 2021 the entire contents of each of which are incorporated herein by reference.

TECHNICAL FIELD

This disclosure relates to ice chests and coolers for maintaining cool temperatures of items stored therein. In particular, the disclosure relates to a liner or basket to be inserted into the ice chest or cooler for easy cleanup and organization.

BACKGROUND

Ice chests, often called coolers, are used for picnics, cookouts, camping trips, fishing outings, and many other activities to keep food or drinks cool. Generally, ice is placed in the ice chest to cool food or beverages placed inside the ice chest. However, after some time the ice melts and eventually only cold water remains. The water often soaks the food, beverages, or any other object placed inside. When removing the items from the ice chest, the water drips making floors wet and slippery. Additionally, people often must put their hands into cold water to remove items as they are cleaning out the ice chest. People often take out each item individually or may make several trips to bring items from the ice chest inside to a different location. Thus, a practical and simple solution is desired for keeping ice and water in the cooler while quickly and easily removing food or beverages stored therein.

SUMMARY

This disclosure relates to a basket or liner for lining an ice chest. The basket includes four flexible walls configured to roll up, a bottom, and at least two handles. The basket further includes perforations configured to allow water or ice to pass through. The four flexible walls are made of silicone, rubber, elastic, or any similar flexible and deformable material, or any combination thereof.

In further aspects, the handles may be coupled to the flexible walls such that they protrude outward when in use and fold inside the ice chest liner when not in use.

In other aspects, the handles may be slots in at least two of the flexible walls.

In aspects, each flexible wall may include perforations disposed towards the bottom, such that ice or water may pass through the perforations in any direction.

In yet other aspects, the bottom may be made of plastic, silicone, rubber, elastic, or any similar flexible and deformable material, or a combination thereof.

In disclosed aspects, the bottom may include bottom perforations configured to allow water or ice to pass through without collapsing, tearing, ripping, or otherwise compromising the basket or liner.

In aspects, the perforations may be circular with diameters from about less than one inch to about two and a half inches.

In more aspects, the perforations may be slots with lengths from about less than one inch to about two and a half inches.

In some aspects, at least two suction cups may be disposed externally on at least two of the flexible walls. The suction cups may be configured to couple the at least two flexible walls to walls of an ice chest.

In aspects, each of the flexible walls may include a plurality of fasteners along a surface of the flexible walls, the plurality of fasteners configured to enable a height of the flexible walls to be adjusted.

This disclosure also provides a liner for an ice chest having a plurality of adaptable walls, at least one adaptable bottom panel, and a plurality of fasteners disposed along an edge of each adaptable wall and an edge of the at least one adaptable bottom panel. Each adaptable wall includes at least one perforation along a surface thereof. The plurality of fasteners is configured to enable the plurality of adaptable walls to be coupled to each other and to enable the plurality of adaptable walls to be coupled to the at least one adaptable bottom panel.

In aspects, each adaptable wall may be configured to be rolled up or folded.

In aspects, each adaptable wall may include a second plurality of fasteners along a surface thereof to enable a height of each adaptable wall to be adjusted.

In other aspects, the liner may include a handle configured to be coupled to at least one of the adaptable walls of the plurality of adaptable walls.

In some aspects, each adaptable wall may include at least one suction cup removably coupled thereto.

Additionally, this disclosure provides another basket for lining an ice chest, the basket having four flexible walls and a bottom panel. The four flexible walls are configured to roll up. Each flexible wall includes a fastener disposed along at least three edges thereof. The bottom panel includes a fastener along each edge of the bottom panel. The fasteners of the four flexible walls enable the four flexible walls to be coupled to one another and to the fasteners of the bottom panel. At least one flexible wall includes perforations configured to allow water or ice to pass through the perforations.

In aspects, each of the four flexible walls may include a plurality of fasteners disposed along each surface of the four flexible walls to enable a height of each of the four flexible walls to be adjusted.

In aspects, each of the four flexible walls and the bottom panel may include at least one perforation, and at least one of the perforations defines a handle.

In some aspects, the fasteners may be hook and loop fasteners, snap and button fasteners, clip fasteners, zip fasteners, magnetic fasteners, or any combination thereof.

These and other features and advantages of the present disclosure will become apparent from the following description and the associated drawings.

BRIEF DESCRIPTION OF THE DRAWINGS

A better understanding of the features and advantages of the present disclosure will be obtained by reference to the following detailed description that sets forth illustrative aspects and the accompanying drawings of which.

DETAILED DESCRIPTION

Although the present disclosure will be described in terms of specific embodiments, it will be readily apparent to those skilled in this art that various modifications, rearrangements, and substitutions may be made without departing from the spirit of the present disclosure.

The description herein presents numerous specific details included to provide a thorough understanding of the present disclosure. It will be apparent, however, to one skilled in the art that the present disclosure can be practiced without some or all of these specific details. On the other hand, well-known structures, materials, or mechanisms are not described in detail as to not unnecessarily obscure the present disclosure. In addition, directional terms such as front, rear, upper, lower, top, bottom, and the like are used simply for the convenience of description and are not intended to limit the disclosure attached hereto.

Figure 1:
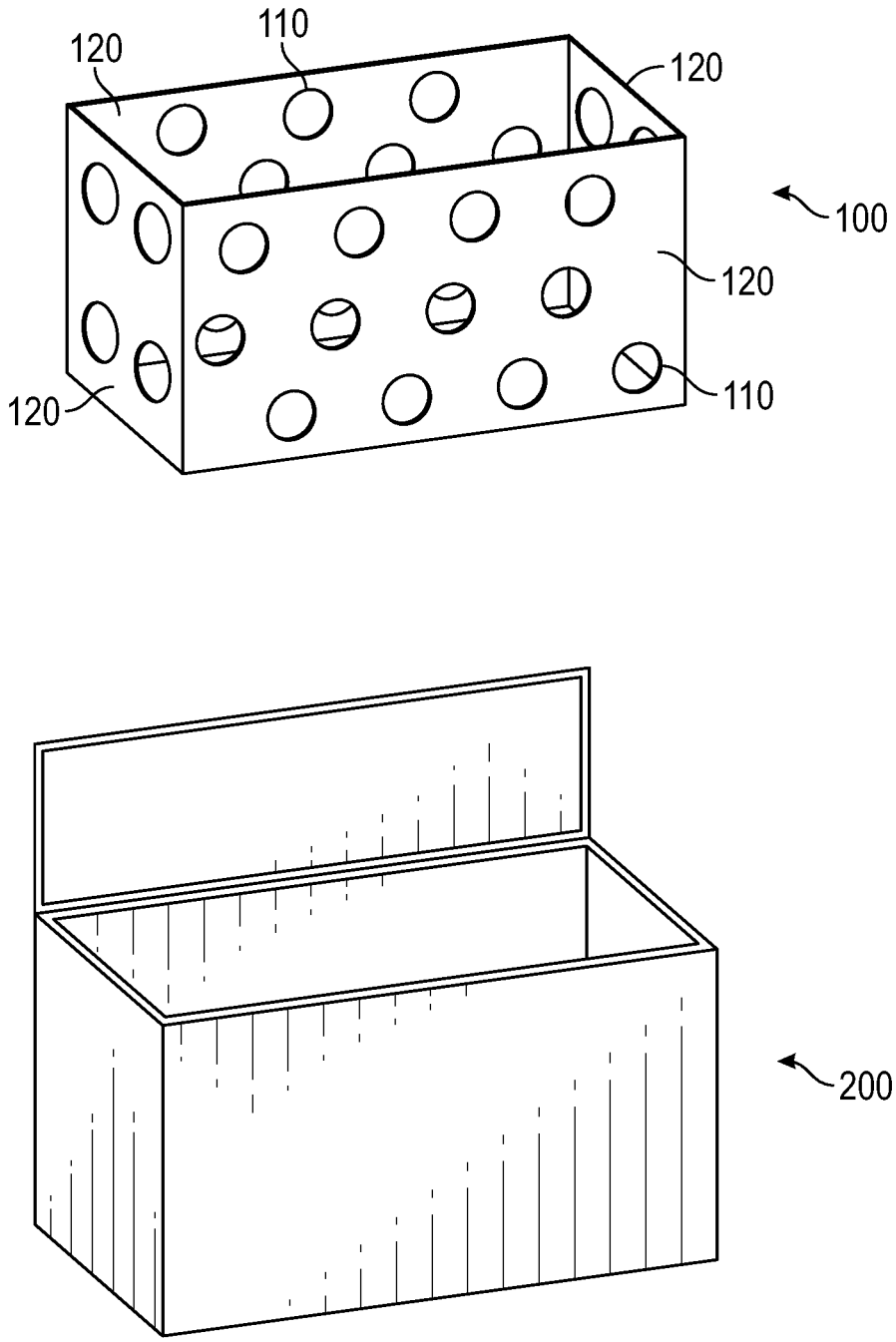
FIG. 1 a perspective view of an ice chest liner and an ice chest.

Referring to FIG. 1, the present disclosure relates to an ice chest basket or ice chest liner 100 that may be inserted into an ice chest or cooler 200. The ice chest liner 100 is configured to form a caddy or basket and includes side walls 120 that at one end define an opening into which items to be cooled may be placed, and at the other end are closed by a bottom 130A (FIG. 3A) on which items placed into the ice chest liner 100 may be supported. The ice chest liner 100 is made from a flexible and water-resistant material such as plastic, silicone, rubber, elastic, or a combination thereof. In aspects, the ice chest liner 100 is flexibly stiff such that walls 120 of the ice chest liner 100 maintain a basket shape when in use but may fully roll up when not in use. The ice chest liner 100 is configured to fit a wide variety of coolers 200 of various sizes and shapes. The ice chest liner 100 may be configured in various sizes suitable for small to large ice chests 200. The ice chest liner 100 may be rectangular or cylindrical.

Figure 2:
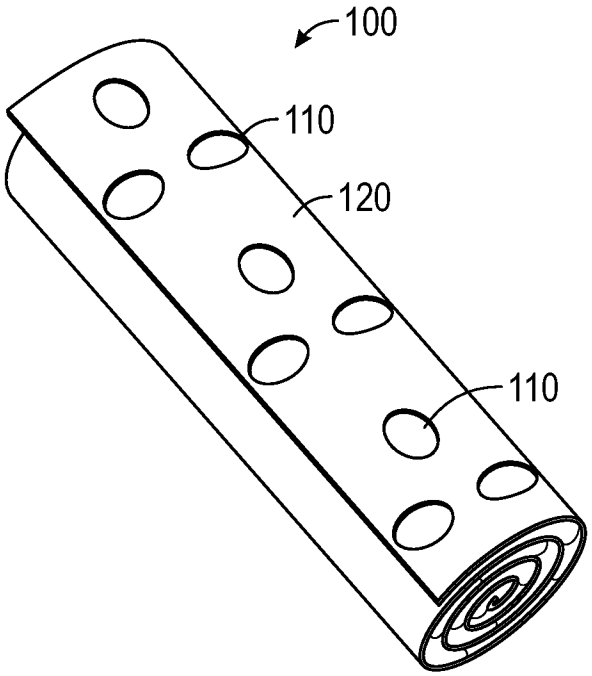
FIG. 2 is a perspective view of the ice chest liner of FIG. 1 in a rolled-up configuration.

With reference to FIG. 2, the ice chest liner 100 is configured to be rolled up such that it may be easily stored and or transported. In aspects, the ice chest liner 100 may be configured to fold flat for easy storage.

The ice chest liner 100 includes strategically located openings or perforations 110. The openings or perforations 110 may be holes, slots, or any combination thereof. The terms "openings" and "perforations" are used interchangeably herein. The perforations 110 are configured to allow water, ice, or both to pass through the ice chest liner 100 while retaining items inside the caddy or basket of the ice chest liner 100. The perforations 110 may be disposed on each wall 120 of the ice chest liner 100.

Any number of perforations 110 may be disposed along each wall 120 of the ice chest liner 100. In aspects, the perforations 110 may be located on each wall 120 closest towards the bottom 130A (FIG. 3A) of the ice chest liner 100. The perforations 110 may be of any size, but typically have a diameter or width from about less than one (1) inch to about two and a half (2.5) inches. If the perforations 110 are slots, the slots may have a width from about less than one (1) inch to about two and a half (2.5) inches.

Referring to FIGS. 2A-B, a bottom 130A of the ice chest liner 100 includes perforations 110. The perforations 110 disposed on the bottom 130A of the ice chest may be equal in size or smaller than the perforations 110 on the walls of the ice chest liner 100. The perforations 110 on the bottom 130A of the ice chest liner 100 may be strategically located such that the bottom 130A maintains sufficient strength and durability to hold items placed into the ice chest liner 100 without collapsing, tearing, ripping, or otherwise compromising the structural integrity of the ice chest liner 100 while still allowing ice and water to pass through. The ice chest liner 100 is configured to be lifted out of the ice chest and support objects therein having a weight from about less than one (1) pound and greater, e.g., over 100 pounds.

Figure 3A:
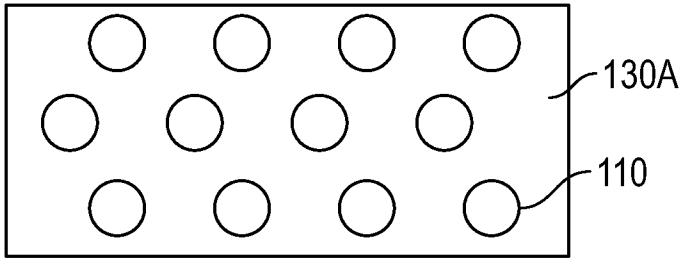
FIG. 3A is a top view of the bottom of the ice chest liner of FIG. 1.
Figure 3B:
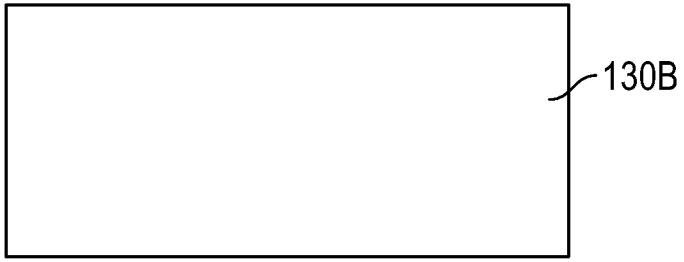
FIG. 3B is a top view of the bottom of an ice chest liner in accordance with another aspect of this disclosure.

In aspects, the ice chest liner 100 includes a bottom 130B having no perforations as shown in FIG. 3B. When the ice chest liner 100 includes a solid bottom 130B having no perforations 110, the ice, water, or both in the ice chest 200 only passes through the perforations 110 disposed on the walls 120. The bottom 130B of the ice chest liner 100 is configured to create a dripping barrier, such that when the ice chest liner 100 is removed from the ice chest, ice and water pass through the perforations of the wall, while significantly reducing the amount of water or ice that may fall onto the floor.

The bottom 130A, 130B may be made of rubber, elastic, or silicone that is configured to be water-wicking.

Figure 4A:
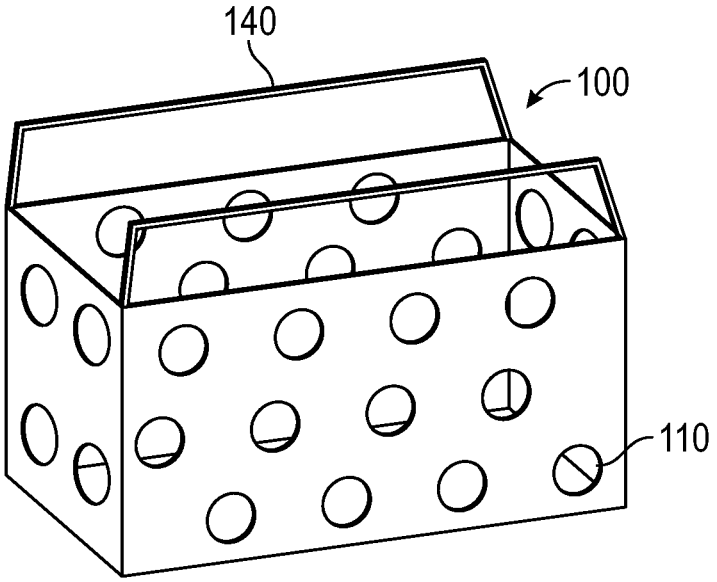
FIG. 4A is a perspective view of an ice chest liner having handles integrated with a wall of the liner.
Figure 4B:
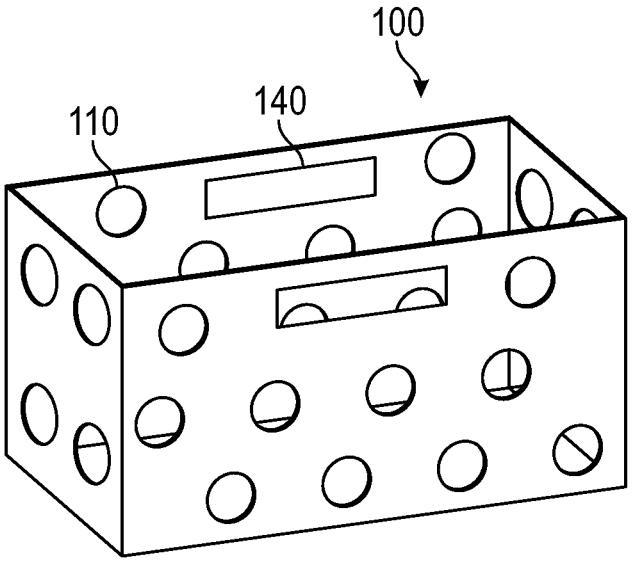
FIG. 4B is a perspective view of an ice chest liner having handles, in accordance with another aspect of this disclosure.

With reference to FIGS. 3A-B, the ice chest liner 100 may include handles 140. The handles 140 may be a rope, bar, or any other handle typically used to carry a basket or caddy. The handles 140 may be folded down internally when not in use, such that when the ice chest liner 100 is in the ice chest 200, the handles 140 do not interfere with the cover of the ice chest 200. In aspects, the handles 140 may be a large perforation 110 configured to be held by a user's hand as illustrated in FIG. 4B. The handles 140 are configured to allow easy and simple removal of the ice chest liner 100 from an ice chest 200.

Figure 5:
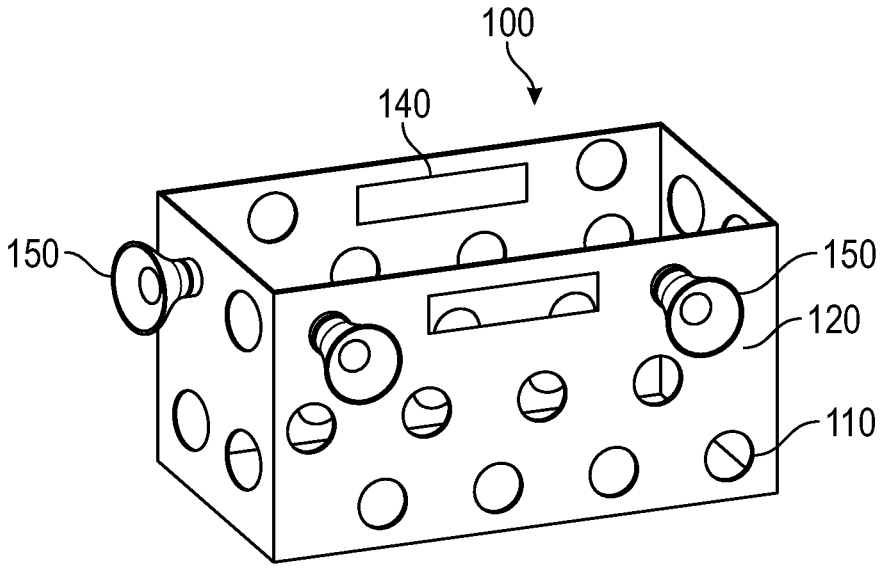
FIG. 5 is a perspective view of an ice chest liner having suction cups.

With reference to FIG. 5, the ice chest liner 100 may include suction cups 150. The suction cups 150 are configured to be pressed onto, and thereby coupled to, the inner walls of an ice chest 200 to hold the ice chest liner 100 in place. At least one suction cup 150 may be disposed externally on each wall 120 of the ice chest liner 100. In aspects, the bottom 130A or 130B may include suction cups 150 such that the bottom of the ice chest liner 100 may be coupled to an internal floor of the ice chest 200. The suction cups 150 allow the ice chest liner 100 to be fixed in place in variously sized and designed ice chests 200. The suction cups 150 may be made of the same materials as the ice chest liner or a different material. The suction cups 150 may be made from plastic (e.g., flexible vinyl coated plastic tarp, vinyl coated nylon, or the like), rubber, elastic, silicone, or any similar suitable material. In aspects, the suction cups 150 may be molded with the ice chest liner 100 or may be made separately and then coupled to the ice chest liner 100.

Figure 6A:
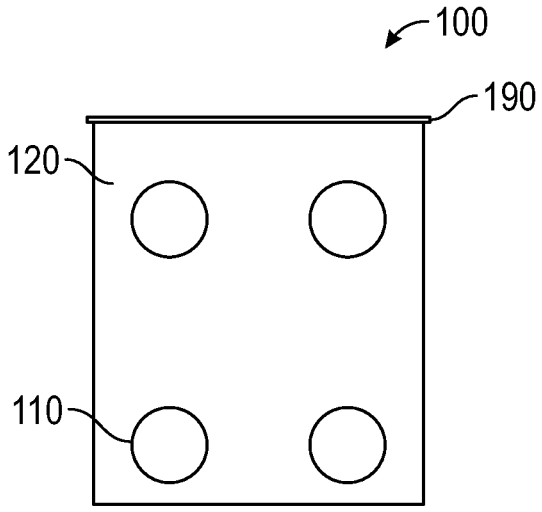
FIGS. 6A-B are side views of an ice chest liner having walls with lips at the top, in accordance with another aspect of this disclosure.
Figure 6B:
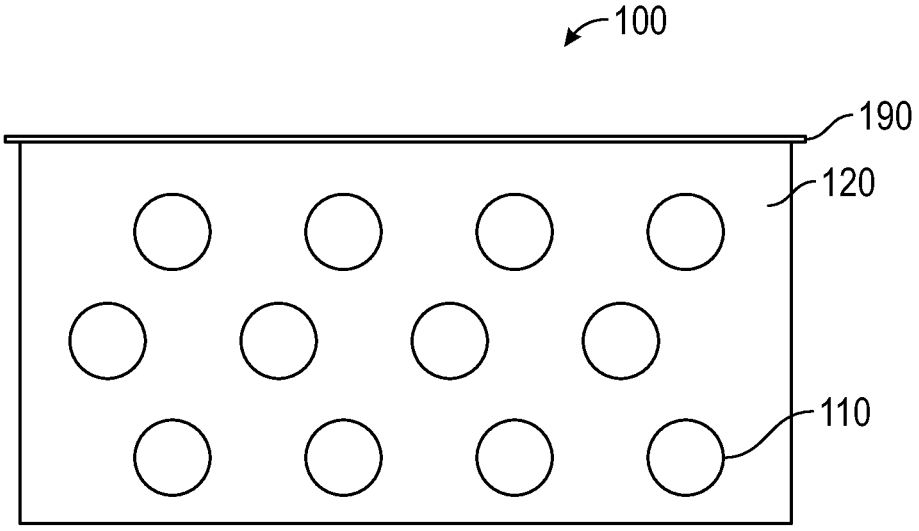

With reference to FIGS. 6A-B, the ice chest liner 100 may include a lip 190 around the top of the walls 120 such that the ice chest liner 100 rests on an internal ledge of an ice chest 200.

The ice chest liner 100 may include lights (not shown) configured to illuminate the inside of the ice chest 200. The lights may be disposed on at least one wall 120 or in the suction cups 150. The lights may be disposed around the lip of the ice chest liner 100 or on the handles 140. The lights may be LED lights configured to change colors.

The ice chest liner 100 allows a user to first place beverages, food, or other items inside the ice chest liner 100 while the ice chest liner 100 is not inserted into the ice chest 200. The ice chest liner 100, with the items stored therein, is then inserted into the ice chest or cooler 200. A user may then place ice, or cold water, into the ice chest 200. In aspects, a user may place the ice chest liner 100 into the ice chest 200 without anything inserted in the ice chest liner 100 and then place items into the cooler 200 by placing them into the ice chest liner 100. At any point, the user may easily remove all the items from the ice chest 200 by picking up the ice chest liner 100. The ice or water, if the ice has melted, or if water was originally placed into the ice chest instead of ice, passes through the perforations for easy cleanup. The ice chest liner 100 allows a user to carry items around without also carrying the extra weight of the ice or water in the ice chest 200. The ice chest liner 100 (or an ice chest liner 300 described in detail below) may be used with any container including live wells or bait buckets, and may include perforations 110 appropriately configured to prevent smaller bait, such as minnows, from slipping through the perforations 110.

Additionally, the ice chest liner 100 allows for simple and convenient organization. Multiple ice chest liners 100 may be used one on top of, next to, or placed in the other. In aspects, two ice chest liners 100 may be used together inside a medium or large ice chest 200 to form a compartment within the ice chest 200.

Figure 7A:
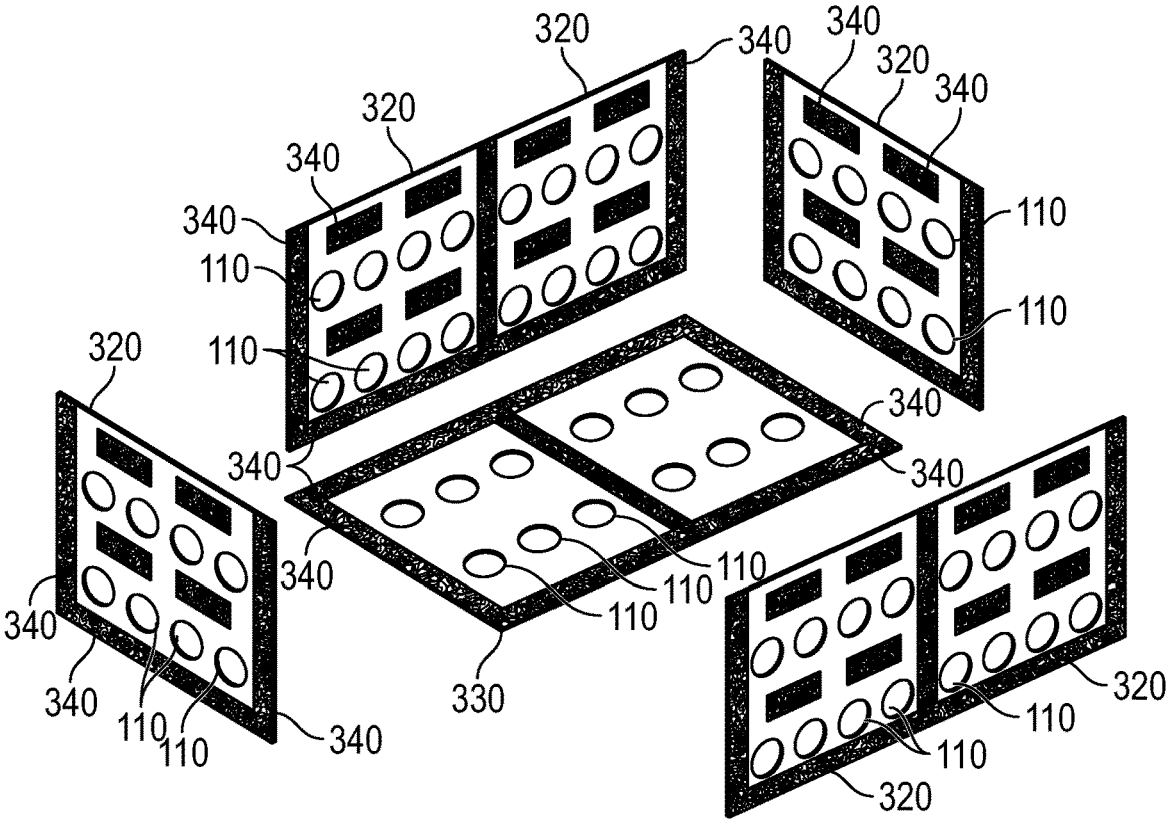
FIGS. 7A-C are perspective views of a reconfigurable ice chest liner in accordance with yet another aspect of this disclosure.
Figure 7B:
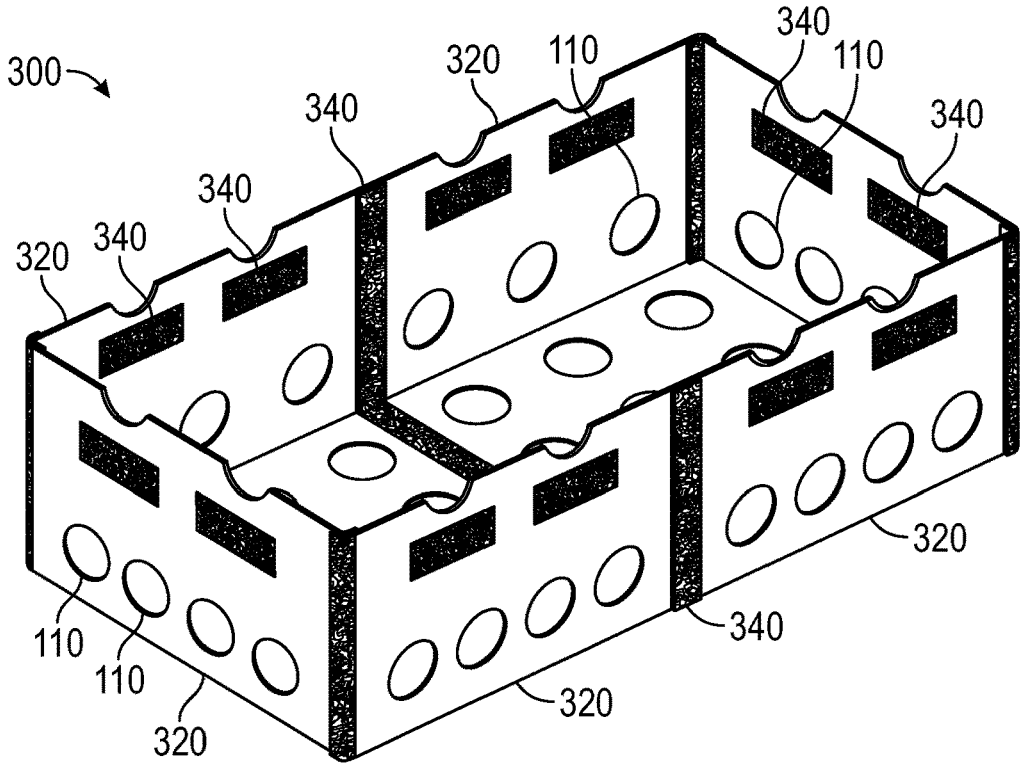
Figure 7C:
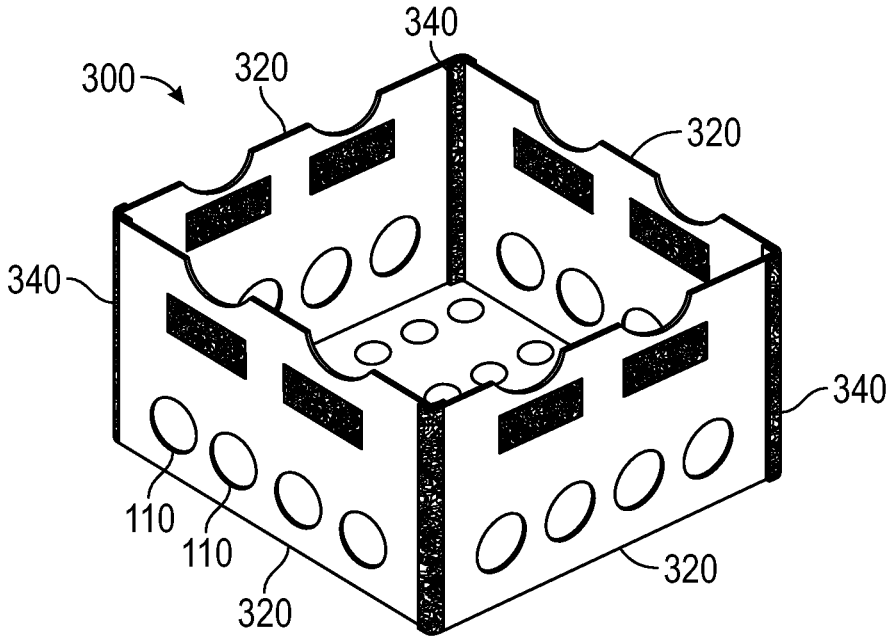

With reference to FIGS. 7A-7C, an adaptable ice chest liner 300 is configured, similar to ice chest liner 100, to line an ice chest or cooler 200 and enable objects disposed in the adaptable ice chest liner 300 to be removed while water and ice remain in or are drained into the ice chest or cooler 200. The adaptable ice chest liner 300 includes the perforations 110, a plurality of adaptable walls 320, and at least one adaptable bottom panel 330. The adaptable ice chest liner 300 may include the handles 140, the suction cups 150, and the lip 190. Any of the features of ice chest liner 100 may be applied, together or separately, to the features of the adaptable ice chest liner 300 and vice versa.

The plurality of adaptable walls 320 is configured to be removably coupled to each other such that the adaptable ice chest liner 300 may be adapted by a user to fit a variety of differently sized ice chests or coolers 200. Each adaptable wall 320 may include a fastener 340 disposed about an edge thereof configured to fasten to another fastener 340 of another adaptable wall 320. The adaptable bottom panel 330 also includes the fastener 340 disposed near edges of the adaptable bottom panel 330 as shown in FIG. 7A. The fastener 340 may be a hook and loop fastener, a snap and button fastener (such as that shown in FIG. 8), a clip fastener, a zip fastener, a magnetic fastener, any other suitable fasteners configured to couple each adaptable wall 320 to each other, or any combination thereof.

For example, as shown in FIG. 7A, the adaptable ice chest liner 300 includes six adaptable walls 320 with fasteners 340 along the edges of each adaptable wall 320 and includes two adaptable bottom panels 330 with fasteners along each edge of the adaptable bottom panels 330. Each adaptable wall 320 includes hook and loop fasteners 340 disposed along the side and bottom edges thereof. In FIG. 7B, two adaptable walls 320 are coupled to each other on each longitudinal side of the ice chest liner 300 and are coupled to one adaptable wall 320 on each end along the width of the ice chest liner 300. In FIG. 7C, the ice chest liner 300 includes only one adaptable wall 320 along each side of the ice chest liner 300 and are each coupled each other and to the adaptable bottom panel 330 via the fasteners 340. It is envisioned that any number of adaptable walls 320 be included.

Each adaptable wall 320 may also be configured to be folded over and coupled to itself via fasteners 340 disposed along the surface of each adaptable wall 320 to adjust a height of the adaptable wall 320. For example, as shown in FIG. 7A, each adaptable wall has a plurality of fasteners 340 disposed along the surface of each adaptable wall and each defines a first height $H_1$ when in an unfolded configuration. As shown in FIG. 7B, each adaptable wall is folded over and coupled to itself via the fasteners 340 such that each adaptable wall defines a second height $H_2$ when in a folded configuration. The second height $H_2$ is smaller than the first height $H_1$. In aspects, the adaptable walls 320 may be vertically coupled and stacked together so as to increase the height of the ice chest liner 300 so as to define a third height $H_3$ that is greater than the first height $H_1$.

Any number of fasteners may be disposed along each surface of each adaptable wall 320 such that each adaptable wall 320 may be adjusted to any desired height to fit variously sized ice chests or coolers 200. Any number of adaptable walls 320 may be included to extend the length or width of the ice chest liner 300. Any number of adaptable bottom panels 330 may be included to further enable the length or width of the ice chest liner 300 to be adjusted. For example, two adaptable bottom panels 330 may be included (as shown in FIG. 7A), one adaptable bottom panel 330 may be included (as shown in FIG. 7C), or ten adaptable bottom panels 330 may be included (not shown).

Each adaptable wall 320 may be of the same length or of a different length as the length of each adaptable bottom panel 330. For example, each adaptable bottom panel 330 may be configured to be coupled to two adaptable walls 320 along each edge of the adaptable bottom panel 330. In another example, each adaptable bottom panel 330 may be configured to be coupled to one adaptable wall 320 along each edge of the adaptable bottom panel 330.

In aspects, each adaptable wall 320 may be coupled to another adaptable wall 320 via fasteners along the surfaces thereof such that each adaptable wall 320 overlaps one another. For example, if each adaptable wall 320 is longer than an adaptable bottom panel 330, the adaptable walls 320 may be coupled to each other via the fasteners 340 such that each adaptable wall 320 overlaps one another so as to match a length and/or a width of the adaptable bottom panel 330.

Each adaptable wall 320 may define a first length "$L_1$." Each adaptable wall 320 may be configured to be folded and fastened to itself along its first length "$L_1$" via the fasteners 340 coupled to each adaptable wall 320 so as to define a second length "$L_2$" that is smaller than the first length "$L_1$." Thus, the length and a width of the adaptable ice chest liner 300 may be adapted to fit an ice chest or cooler 200 without removing an adaptable wall 320.

Each adaptable wall 320 may be permanently fixed to each other similar to the flexible walls of the ice chest liner 100 described above, with the fasteners 340 disposed along each surface of the adaptable walls 320 and with no fasteners 340 along the edges of the adaptable walls 320.

Figure 8:
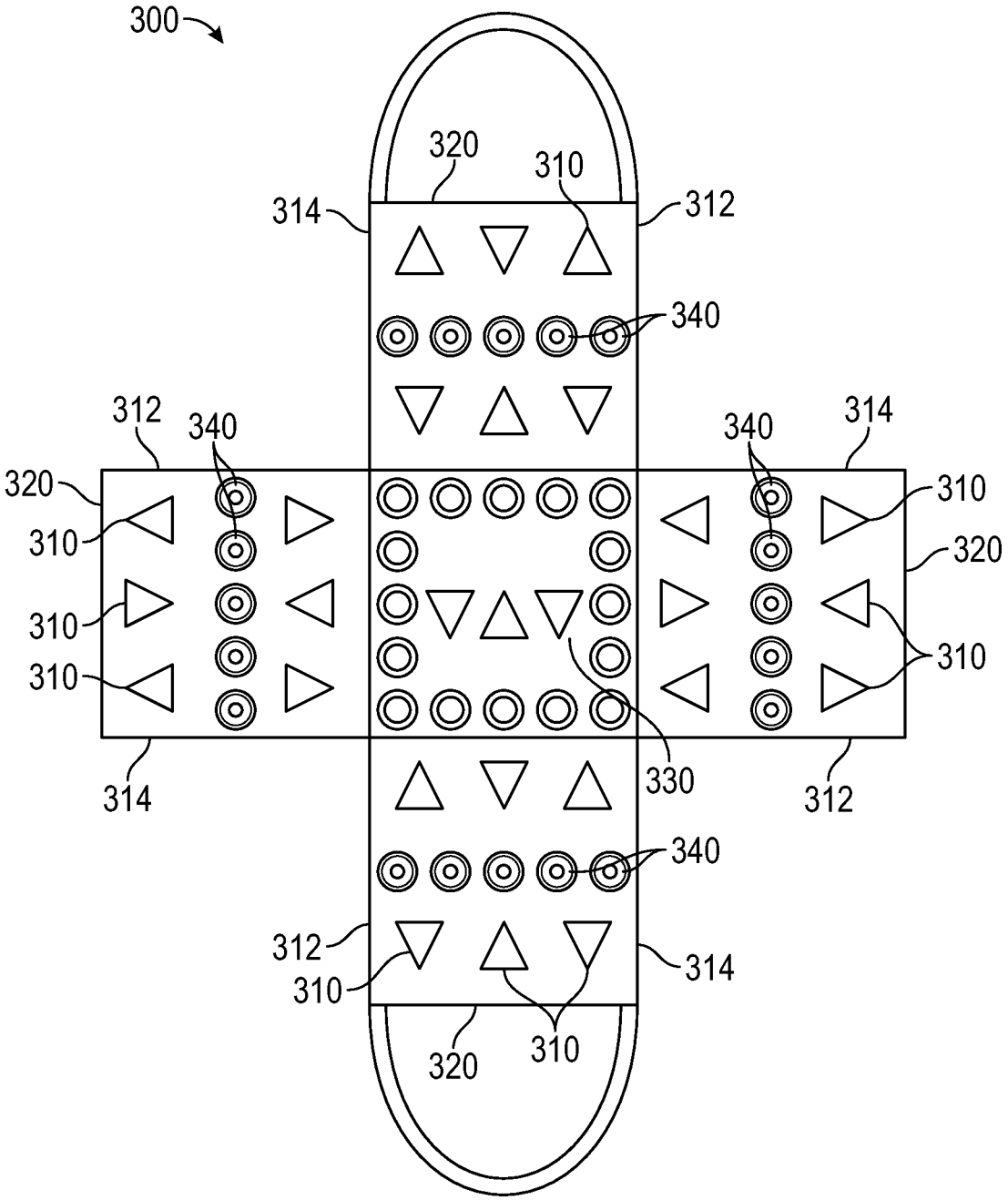
FIG. 8 is a top view of an example sheet of material for forming a reconfigurable ice chest liner.

With additional reference to FIG. 8, advantageously, the adaptable walls 320 of the adaptable ice chest liner 300 may be produced together from a single sheet of a flexible material, such as silicon, flexible plastic, flexible vinyl coated plastic tarp, vinyl coated nylon, or the like, or may each be permanently joined to define a single sheet of flexible material such that, when the adaptable walls are in a fully extended position (e.g., not fastened at any point via fasteners 340), the adaptable walls 320 do not come apart. Further, the adaptable bottom panel 330 may similarly be permanently coupled to the adaptable walls 320 along the edges of the adaptable bottom panel 330.

For example, the adaptable walls 320 may be sewn together at vertical edges thereof to each other and along bottom edges to the adaptable bottom panel 330. In the example, the inner and/or outer surfaces of the adaptable walls 320 and the adaptable bottom panel 330 may each include a plurality of fasteners 340. In another example, and as shown in FIG. 8, the adaptable walls 320 may be formed from a single sheet of flexible material and sewn along the bottom edge of the single sheet of flexible material to the adaptable bottom panel 330. In yet further examples, the adaptable walls 320 and the adaptable bottom panel 330 may be formed from a single sheet of flexible material sewn to itself at various sections thereof to define each adaptable wall 320 and the adaptable bottom panel 330. In the latter example, the single sheet of material may be in the shape of a "+" and the right edge 312 of an adaptable wall 320 is sewn to the left edge 314 of an adjacent adaptable wall 320.

In aspects, the fasteners 340 may be disposed on each side of the adaptable walls 320. In aspects, the handles 140 may be coupled to the adaptable ice chest liner 300 via the fasteners 340. The suction cups 150 may also be coupled to the ice chest liner 300 via the fasteners 340.

It should be understood the foregoing description is only illustrative of the present disclosure. Various alternatives and modifications can be devised by those skilled in the art without departing from the disclosure. Accordingly, the present disclosure is intended to embrace all such alternatives, modifications, and variances. The aspects described with reference to the attached drawing figures are presented only to demonstrate certain examples of the disclosure. Other elements, constructions, or materials that are insubstantially different from those described above and/or in the appended claims are also intended to be within the scope of the disclosure.

What is claimed is:

1. A basket for lining an ice chest comprising:

four flexible walls configured to roll up, at least one of the four flexible walls including a plurality of fasteners along a surface of the at least one of the four flexible walls, the plurality of fasteners configured to enable a height or a length of the at least one of the four flexible walls to be adjusted when the at least one of the four flexible walls is in an unrolled configuration;

a bottom configured to collapse; and at least two handles;

wherein at least one wall includes perforations configured to allow water or ice to pass through the perforations; and wherein the four flexible walls are made of plastic, silicone, rubber, elastic, or any combination thereof.

2. The basket for lining an ice chest of claim 1, wherein the at least two handles are coupled to the flexible walls such that they protrude outward when in use and fold inside the basket when not in use.

3. The basket for lining an ice chest of claim 1, wherein the at least two handles are each defined by a slot adjacent an upper edge of at least two respective flexible walls, each of the at least two handles defined by a single surface of each respective flexible wall, wherein a portion of each respective flexible wall above the slots is configured to be grasped by a hand.

4. The basket for lining an ice chest of claim 1, wherein each of the four flexible walls includes the perforations.

5. The basket for lining an ice chest of claim 1, wherein the bottom is made of plastic, silicone, rubber, elastic, or any combination thereof.

6. The basket for lining an ice chest of claim 1, wherein the bottom includes bottom perforations configured to allow water or ice to pass through without collapsing, tearing, ripping, or compromising the basket.

7. The basket for lining an ice chest of claim 1, wherein the perforations are circular with diameters from less than one inch to about two and a half inches.

8. The basket for lining an ice chest of claim 1, wherein the perforations are polygonal with widths from less than one inch to about two and a half inches.

9. The basket for lining an ice chest of claim 1, further comprising at least two suction cups disposed externally on at least two of the flexible walls and configured to couple the at least two flexible walls to walls of an ice chest.

10. A liner for an ice chest comprising:

a plurality of adaptable walls removably coupled to and re-attachable to each other, each adaptable wall including at least one perforation along a surface thereof;

at least one adaptable bottom panel; and a plurality of fasteners disposed adjacent an edge of each adaptable wall and an edge of the at least one adaptable bottom panel, the plurality of fasteners configured to enable the plurality of adaptable walls to be removably coupled to and re-attachable to each other and to enable the plurality of adaptable walls to be removably coupled to and re-attachable to the at least one adaptable bottom panel;

wherein the plurality of adaptable walls are configured to be transitionable between an assembled state and an unassembled state, via the plurality of fasteners, such that when in the assembled state at least two adaptable walls of the plurality of walls are coupled to each other and the adaptable bottom panel and when in the unassembled state each of the adaptable walls are discretely disconnected from each other.

11. The liner for an ice chest of claim 10, wherein each adaptable wall is configured to be rolled up or folded.

12. The liner for an ice chest of claim 11, wherein each adaptable wall includes a second plurality of fasteners along a surface thereof to enable each adaptable wall to be folded over and coupled to itself to adjust a height of each adaptable wall.

13. The liner for an ice chest of claim 10, further comprising a handle configured to be coupled to at least one of the adaptable walls of the plurality of adaptable walls.

14. The liner for an ice chest of claim 10, wherein each adaptable wall includes at least one suction cup removably coupled thereto, the suction cup configured to be able to be detached and re-attached to a respective adaptable wall.

15. A basket for lining a container comprising:

four flexible walls each configured to roll up, each flexible wall including a fastener disposed along at least three edges of each of the flexible walls; and a bottom panel including a fastener along each edge of the bottom panel;

wherein the fasteners of the four flexible walls enable the four flexible walls to be removably coupled to and re-attachable to each other and to the fasteners of the bottom panel; and wherein at least one flexible wall includes perforations configured to allow water or ice to pass through the perforations.

16. The basket for lining a container of claim 15, wherein the four flexible walls are made of silicone, rubber, elastic, or any combination thereof.

17. The basket for lining a container of claim 15, wherein each of the four flexible walls includes a plurality of fasteners disposed along each surface of the four flexible walls to enable a height of each of the four flexible walls to be adjusted.

18. The basket for lining a container of claim 15, wherein each of the four flexible walls and the bottom panel include at least one perforation, and at least one of the perforations defines a handle.

19. The basket for lining a container of claim 15, wherein the fasteners are hook and loop fasteners, snap and button fasteners, clip fasteners, zip fasteners, magnetic fasteners, or any combination thereof.

20. The basket for lining a container of claim 15, wherein at least one of the flexible walls includes a handle defined by a slot adjacent an edge of the at least one of the flexible walls.

* * * * *